United States Patent [19]

Young et al.

[11] 3,997,139

[45] Dec. 14, 1976

[54] KNOCKDOWN AQUARIUM STAND

[75] Inventors: Richard S. Young, Frankenmuth; Leo E. Hearn, Flint, both of Mich.

[73] Assignee: Pentaco Enterprises Corporation, Clio, Mich.

[22] Filed: Nov. 23, 1973

[21] Appl. No.: 418,408

[52] U.S. Cl. ..... 248/165; 108/111; 108/159; 248/188.1

[51] Int. Cl.[2] ..... F16M 11/32

[58] Field of Search ..... 248/165, 188.1; 108/111, 109, 153, 157, 159

[56] References Cited

UNITED STATES PATENTS

| | | | |
|---|---|---|---|
| 2,794,496 | 6/1957 | Strand | 248/165 |
| 3,013,670 | 12/1961 | Mayer | 108/111 |
| 3,172,376 | 3/1965 | Havlis | 108/111 |

FOREIGN PATENTS OR APPLICATIONS

| | | | |
|---|---|---|---|
| 565,854 | 8/1957 | Italy | 248/165 |

*Primary Examiner*—Roy D. Frazier
*Assistant Examiner*—Darrell Marquette
*Attorney, Agent, or Firm*—Learman & McCulloch

[57] ABSTRACT

An easily assembled and disassembled, aquarium stand wherein a pair of longitudinally spaced, generally vertical, springable end frame members have upper portions removably supporting an upper aquarium supporting frame and lower portions supporting a lower frame. Braces, which are fixed to the upper frame section, engage and hold the end frame members in sprung positions of assembly with the upper and lower frames.

7 Claims, 4 Drawing Figures

KNOCKDOWN AQUARIUM STAND

BACKGROUND OF THE INVENTION

This invention relates to an easily assembled and disassembled stand for an aquarium or the like. At least one prior art aquarium stand includes a plurality of individual, wrought iron frame pieces which are welded together. Although such stands, when assembled, are rigid, their assembly requires skilled labor and special equipment and the assembled stands are relatively difficult to pack and bulky to ship. If the individual aquarium stand sections are connected by bolts, the bolt holes must be accurately positioned. In addition, the use of bolts increases packaging costs and complicates assembly. Accordingly, it is an object of the present invention to provide a boltless, easily assembled and disassembled aquarium stand.

Another object of the present invention is to provide a method of easily assembling and disassembling a boltless, knockdown aquarium stand.

Other objects and advantages of the present invention will become apparent to those of ordinary skill in the art as the description thereof proceeds.

SUMMARY OF THE INVENTION

A knockdown stand for supporting an object, such as an aquarium, comprising a pair of springable, longitudinally extending, end frame members and a pair of transversely extending frame members removably supported by the longitudinal frame members and holding the end frame members in sprung or distorted conditions.

The present invention may more readily be described by reference to the accompanying drawings in which.

DESCRIPTION OF THE PREFERRED EMBODIMENT

Figure 1:
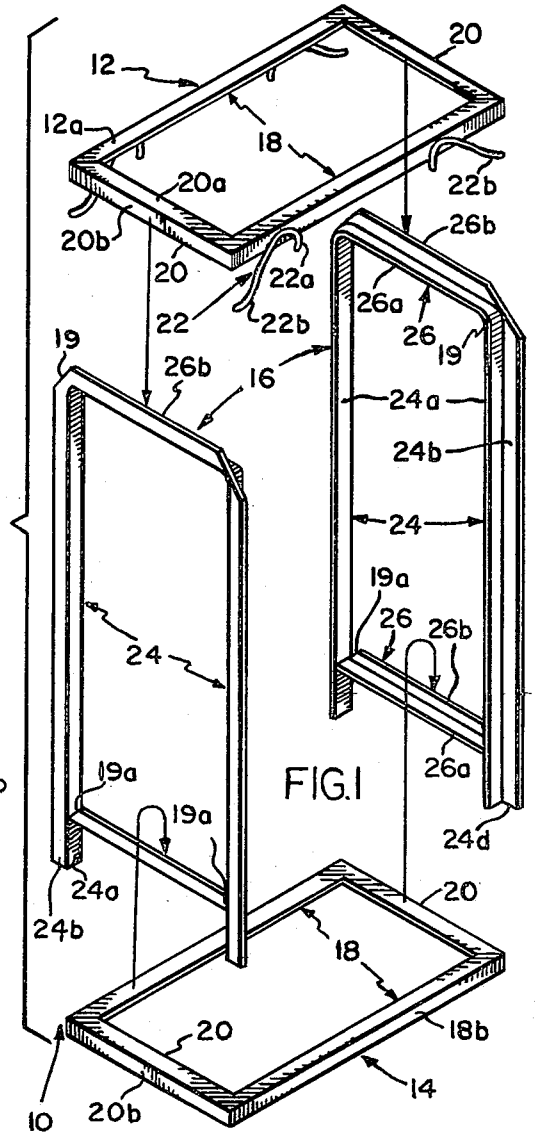
FIG. 1 is an exploded, perspective view of an aquarium stand constructed according to the present invention.

The aquarium stand illustrated in FIGS. 1 – 4 is generally designated 10 and includes top and bottom, generally rectangular, open framework, springable shelf frame members, generally designated 12 and 14, and a pair of vertical, springable, end frame members, generally designated 16. The top and bottom frame members 12 and 14 each include a pair of side angle iron frame sections 18, spanned by a pair of end angle iron frame sections 20. An aquarium (not shown) may be supported on the upper frame member 12.

Figure 2:
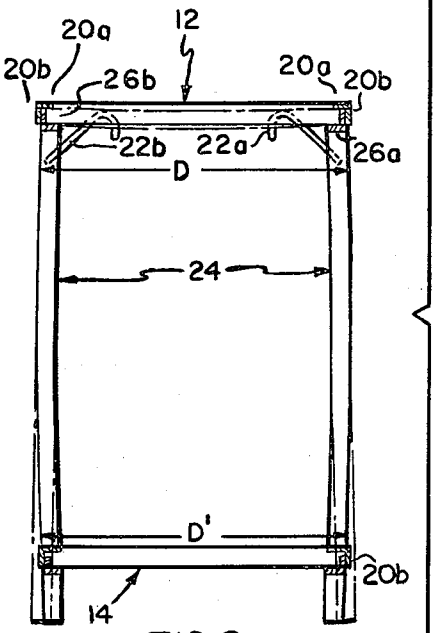
FIG. 2 is a sectional side view of an aquarium stand constructed according to the present invention, taken along the line 2—2 of FIG. 3.
Figure 3:
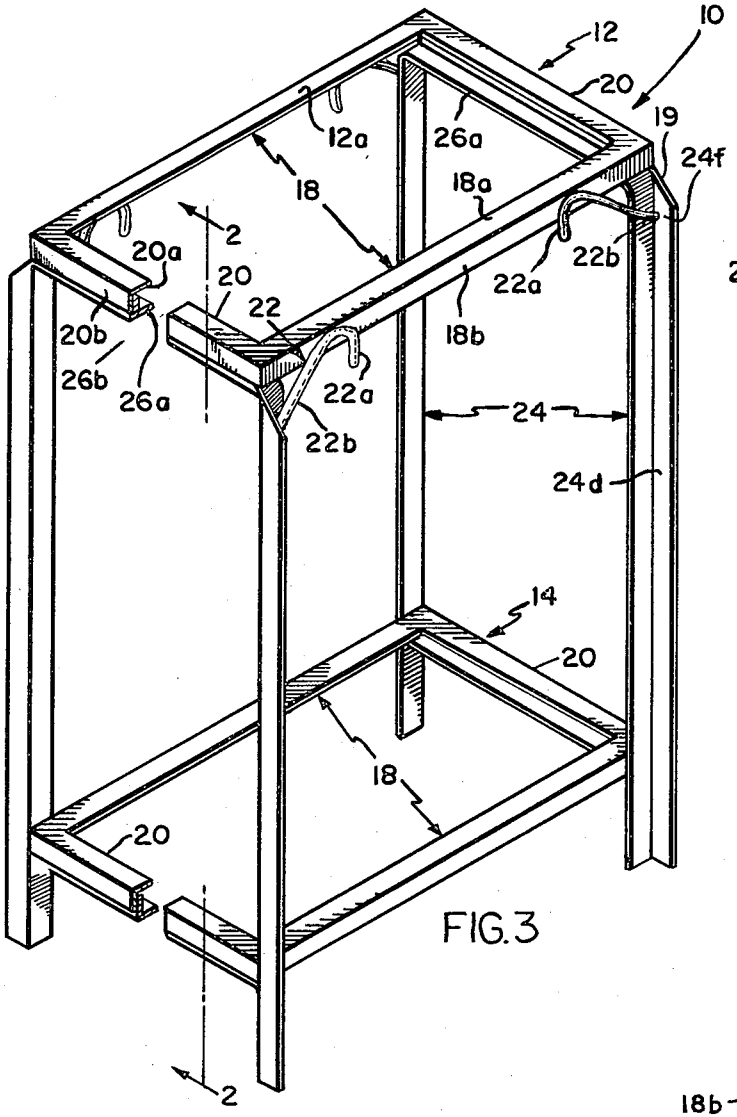
FIG. 3 is an enlarged, perspective view of an aquarium stand constructed according to the present invention, an upper part of the stand being broken away.

As illustrated in FIG. 3, the side and end angle iron frame sections 18 and 20 include horizontal flange portions 18*a* and 20*a*, respectively integrally joined to vertical flange portions 18*b* and 20*b*, respectively. The side angle iron sections 18 of the top frame member 12 are normally slightly downwardly and outwardly bowed prior to assembly as illustrated in chain lines in FIG. 2.

Each of the end frame members 16 includes a pair of vertical angle posts 24 spanned by upper and lower angle iron cross braces 26. The vertical posts 24 include vertically extending, side flange portions 24*a* joined to vertically extending, end flange portions 24*b* to provide bearing surfaces 24*d*. The upper and lower cross braces 26 each include horizontal flange portions 26*a* joined to the lower ends of vertical flange portions 26*b*. Segments of the upper vertical end flange portions 26*b* and the vertical side flange portions 24*b* are cut away as at 19 to receive the vertical side flanges 18*b* of the top frame member 12. Segments of the lower vertical end flange portions 26*b* are also cut away as at 19*a* to receive the vertical side flanges 18*b* of the lower frame member 14. The outer dimensions of the upper and lower frame members 12 and 14 may be identical. The vertical flanges 26*b* on the upper and lower end frames are received between the vertical end flanges 20*b* of the upper and lower frames.

Figure 4:
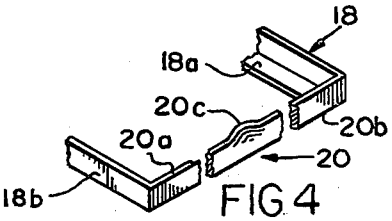
FIG. 4 is an enlarged underplan, perspective view of an end frame portion of the lower support frame section.

The end frames 16, as well as the top and bottom frames 12 and 14, are constructed of spring steel, wrought iron, or other resilient material which permits the end frame members 16 to be sprung, without being permanently deformed, during the assembly of the stand. The vertical flanges 24*b* and 26*b* of the end frame members 16 normally lie in the same vertical plane, as is illustrated in chain lines in FIG. 2. When the stand is assembled, the end frame members 16 are sprung or deformed to the positions shown in FIG. 2. The vertical end flanges 20*b* of the lower frame 14, include locking detents 20*c*, as illustrated in FIG. 4, for locking the bottom frame 14 to the lower vertical brace flanges 26*b*.

Mounted on the side frame sections 18 of the upper frame member 12 are a plurality of tension brace members, generally designated 22. Each brace member 22 includes a hook-shaped or curvilinear portion 22*a* welded or otherwise fixed to the upper vertical side walls 18*b* and a free end portion 22*b* which diverges downwardly away from the side frame section 18. The braces 22 may also be fashioned of wrought iron.

The tension brace members 22 are positioned so that the end portions 22*b* pass laterally outwardly of the vertically extending, side flange portions 24*a* and abut the vertically extending, end flanges 24*b* of the vertical end frame posts 24 at load bearing surfaces 24*d*. The braces 22 are so positioned and are of such length that when the upper end frame vertical flanges 26*b* are received between the upper frame end flanges 20*b*, the lower end frame vertical flanges 26*b* are, during the initial stage of assembly, held by the braces 22 in the downwardly diverging, spread positions, illustrated in chain lines in FIG. 2. When the stand is assembled, the braces 22 maintain the end frame member portions 24*f* of the confronting flanges 24*b*, intermediate the upper and lower frames 12 and 14 and the upper and lower cross braces 26, bowed outwardly. After the aquarium is assembled, the distance D between the intermediate end frame portions 24*f* of the confronting flanges 24*b* adjacent the free ends 22*b* of the brace members 22 is greater than the distance D′ between the upper and lower cross brace vertical flanges 26*b*. The lower frame section 14 holds the end frame members 16 in the sprung or bowed positions against the return "spring" of the end frame members.

METHOD OF ASSEMBLING THE AQUARIUM STAND

The aquarium stand 10 is assembled by mounting the upper frame section 12 atop the end frame sections 16 so that the free ends 22*b* of the tension brace members 22 bear against the vertically extending end flanges 24*b* on the upstanding posts 24 and the vertical flanges 26*b* on the upper end cross braces 26*a* are received between the vertical end flange portions 20*b* of the upper frame section 12.

One vertical flange 20*b* of the lower frame member 14 is hooked over one of the lower vertical end frame flanges 26*b*. The lower ends of the end frame members 16 are then forced together to spring the end frame members 16 from the positions illustrated in chain lines in FIG. 2, to the bowed positions illustrated in solid lines in FIG. 2. The other vertical flange 20*b* of the lower frame member 14 is then slipped or hooked over the other lower end frame flange 26*b*, as illustrated in FIG. 2, to prevent the end frame sections 16 from springing back to the positions illustrated in chain lines. The spring or memory of the material 16 urges the upper ends of legs 16 to swing outwardly about the brace members 22, which act as fulcrums, into tight engagement with the vertical end flanges 20*b* of the upper aquarium frame member 12. The spring tension of the end frame members 16 produces an outward thrust which holds the various parts tightly together but permits quick disassembly for storage and for shipment.

As the lower end portions of the end frame members are sprung together, the brace members 22 are forced together slightly to move the intermediate section of the upper frame member 12 upwardly from the position illustrated in chain lines in FIG. 2 to the position illustrated in solid lines in FIG. 2, against the "spring" or memory of the wrought iron material, until the upper surface 12*a* of the upper frame 12 lies in a horizontal plane. This added spring tension aids in holding the parts together.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. A knockdown support stand comprising elongate resiliently bendable leg means having upwardly projecting first flange portions at their upper ends, an upper peripheral frame member having a peripheral downwardly extending first flange adapted to engage said first flange portions of said leg means, brace members on said upper frame member inclined downwardly from said upper frame member to project below said first flange on said upper member and engageable with said leg means at a location spaced downwardly from said first flange portions when said first flange portions are engaged with said first flange to normally locate said leg means in an outwardly and downwardly divergent relationship relative to each other, upwardly projecting second flange portions on said leg means at a location intermediate the ends of said leg means, and a lower peripheral frame member having a peripheral downwardly extending second flange adapted to engage the outer sides of said second flange portions to hold said leg means in a generally vertical relationship wherein said leg means are resiliently bent inwardly from the divergent relationship established by said first flange and said brace members.

2. The stand as set forth in claim 1 wherein said brace members comprise generally hook-shaped portions engageable with said leg means.

3. The stand as set forth in claim 1 wherein each of said leg means comprises upstanding end frame sections having a pair of generally vertical legs spanned by upper and lower generally horizontal members; said first and second flange portions being located on said upper and lower horizontal members; said first and second flanges at opposite ends of said upper and lower frame members receiving the flange portions on said generally horizontal members therebetween.

4. The stand as set forth in claim 1 wherein each of said leg means includes a pair of upstanding support legs spanned by upper and lower horizontal members, each of said support legs including integral vertical webs at right angles to each other, said brace members mounted on said upper frame member inwardly of the ends thereof and inclined downwardly therefrom to be received at the junction of said webs.

5. The apparatus of claim 4 wherein at least said upper horizontal member includes said upstanding first flange portion, the first flanges of said upper frame member being positioned longitudinally outwardly of said first flange portions.

6. The apparatus of claim 4 wherein said lower frame member is received between said upstanding support legs.

7. The apparatus of claim 6 wherein said lower frame member includes a peripherally extending frame including a generally horizontal flange and a generally vertical flange constituting said second flange, said vertical flange including side portions joined to end portions which are disposed outwardly of said lower horizontal members, said lower horizontal members, being vertically relieved to receive side portions of said vertical flange.

* * * * *